US007150426B2

(12) United States Patent
Huttunen

(10) Patent No.: US 7,150,426 B2
(45) Date of Patent: Dec. 19, 2006

(54) SPOOLING APPARATUS

(75) Inventor: Martti Huttunen, Espoo (FI)

(73) Assignee: Maillefer S.A., Ecublens (CH)

( * ) Notice: Subject to any disclaimer, the term of this patent is extended or adjusted under 35 U.S.C. 154(b) by 0 days.

(21) Appl. No.: 10/517,635

(22) PCT Filed: Jun. 18, 2003

(86) PCT No.: PCT/FI03/00496

§ 371 (c)(1),
(2), (4) Date: Dec. 13, 2004

(87) PCT Pub. No.: WO04/000707

PCT Pub. Date: Dec. 31, 2003

(65) Prior Publication Data

US 2005/0211044 A1 Sep. 29, 2005

(30) Foreign Application Priority Data

Jun. 24, 2002 (FI) ..... 20021229

(51) Int. Cl.
*B65H 54/71* (2006.01)

(52) U.S. Cl. ..... 242/487.9; 242/474.7; 242/487.6; 242/911; 83/601; 83/649; 83/950

(58) Field of Classification Search ..... 242/474.7, 242/476.6, 487.6, 487.9, 488, 911; 30/194, 30/244, 245; 83/589, 601, 607, 649, 650, 83/913, 950

See application file for complete search history.

(56) References Cited

U.S. PATENT DOCUMENTS

| | | | | |
|---|---|---|---|---|
| 2,396,731 | A * | 3/1946 | Wiener | 114/221 A |
| 2,546,636 | A * | 3/1951 | Hanson et al. | 242/474.4 |
| 2,674,414 | A * | 4/1954 | Hicks et al. | 242/474.7 |
| 2,810,436 | A * | 10/1957 | Cheshko | 83/308 |
| 3,526,348 | A | 9/1970 | Morrocco, III et al. | 225/93 |
| 3,913,858 | A * | 10/1975 | Ikegami | 242/474.4 |
| 3,962,943 | A | 6/1976 | Allen | 83/370 |
| 4,015,785 | A * | 4/1977 | Ikegami et al. | 242/474.4 |
| 4,254,679 | A * | 3/1981 | Mathey | 83/575 |
| 4,283,851 | A * | 8/1981 | Wolter | 30/134 |
| 4,716,801 | A | 1/1988 | Spaller, Jr. | 83/286 |
| 4,805,547 | A * | 2/1989 | Matsuzaki et al. | 114/221 A |
| 4,826,103 | A * | 5/1989 | McKown | 244/1 R |
| 5,593,101 | A * | 1/1997 | Varga | 242/474.7 |
| 5,716,017 | A * | 2/1998 | Kemppi et al. | 242/474.7 |
| 6,526,858 | B1 * | 3/2003 | Smith et al. | 83/856 |

FOREIGN PATENT DOCUMENTS

| | | | |
|---|---|---|---|
| FI | 100790 B | | 2/1998 |
| GB | 913320 | | 12/1962 |
| JP | 06045172 A | * | 2/1994 |
| JP | A 10-139283 | | 5/1998 |

(Continued)

*Primary Examiner*—William A. Rivera
*Assistant Examiner*—William E. Dondero
(74) *Attorney, Agent, or Firm*—Oliff & Berridge, PLC

(57) ABSTRACT

Spooling apparatus comprising means for rotatably mounting a first reel and a second reel, catching means for guiding a thread (1) to be spooled onto the first reel and further to the second reel and cutting means (5) for cutting the thread to be spooled when the thread to be spooled is guided from the first reel onto the second reel. The cutting means (5) comprises at least one cutting blade (7) which is moved at least in the cutting direction (K) as a result of the tension of the thread (1) to be cut.

5 Claims, 1 Drawing Sheet

FOREIGN PATENT DOCUMENTS

RU 2 051 080 C1 12/1995

SU 1412940 A1 7/1988

* cited by examiner

SPOOLING APPARATUS

Figure 1:
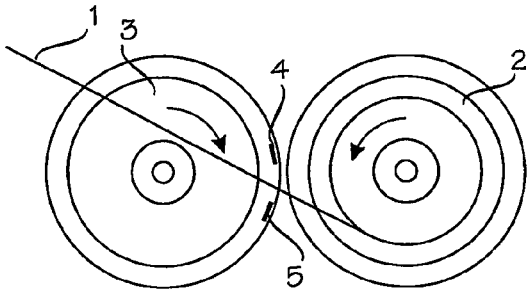

The present invention relates to a spooling apparatus comprising means for rotatably mounting a first reel and a second reel, catching means for guiding a thread to be spooled onto the first reel and further to the second reel and cutting means for cutting the thread to be spooled when the thread to be spooled is guided from the first reel onto the second reel.

Spooling apparatuses of the type described above are currently widely known in different industrial fields. Electric cable industry can be mentioned as an example of industrial fields in which solutions of this type are used.

The basic principle of the previously known solutions has been that after a reel has become full, the thread to be spooled is moved onto the path of the catching means rotating with an empty reel. The catching means grips the thread and guides the thread onto the empty reel, and draws also the thread so that the thread is pulled against cutting means for cutting the thread to be spooled. The cutting means is formed by a stationary V-shaped cutting blade construction intended to cut the thread to be spooled as it is pulled towards the bottom of the V-shaped slot by the force created by the catching means rotating with the reel.

Examples of publications in which the prior art is described, and solutions disclosed are U.S. Pat. Nos. 5,716,017, 5,593,101, 4,015,785, 3,913,858, 2,674,414 and 2,546,636, and British Patent No. 1 292 912.

The disadvantage of the prior art is that hard to cut products, for example multi-conductor cables can be damaged during cutting. This is due to the fact that a passive, V-shaped cutting slot is used the cutting event is so slow that in certain circumstances only a part of the conductors are cut by the cutting slot, and the rest of the conductors are broken as a result of the drawing force created by the catching means.

In cable industry it is also known to use a shear or like scissor type tools for cutting cables. Said tools are power-actuated tools. A typical example these power-actuated tools is described in U.S. Pat. No. 4,283,851.

The disadvantage of the power-actuated tools is that use of said tools is very difficult in practice. This is due to the fact that production speeds are nowadays so high that it is in practice very difficult to synchronise cutting event to the production speed.

The object of the invention is to provide an apparatus by means of which the disadvantages of the prior art can be eliminated. Said object is obtained with the present invention. The spooling apparatus of the invention is characterized in that the cutting means comprises at least one cutting blade which is moved at least in the cutting direction as a result of the tension of the thread to be cut.

The principal advantage of the invention is that even hard to cut cables can be cut very effectively by using the present invention. The present invention is also very suitable for high production speeds because synchronisation which has caused problems in the prior art, takes place quite automatically. The advantage of the invention is also its simplicity whereby the implementation of the invention is advantageous, ie. no complex structures are needed and maintenance costs are low.

Figure 2:
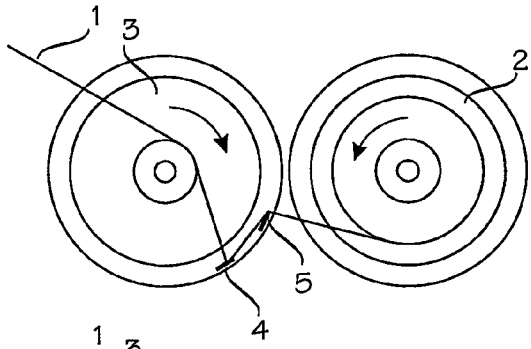
Figure 3:
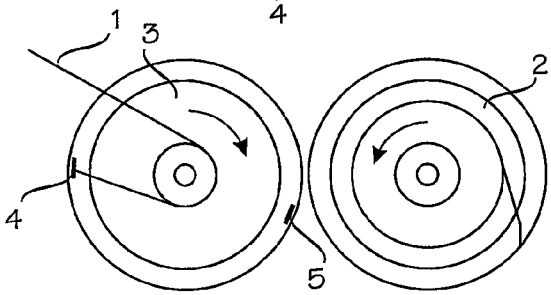
Figure 4:
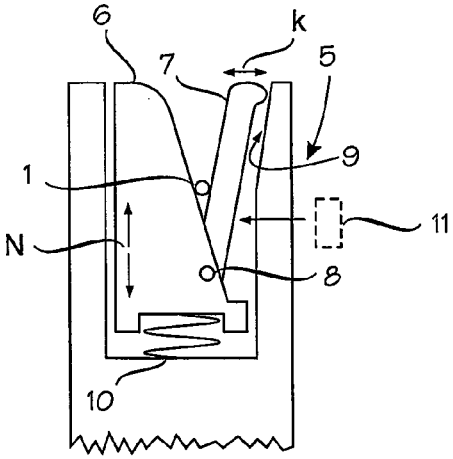
Figure 5:
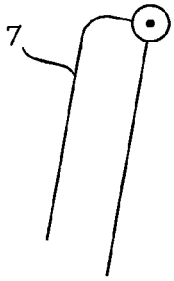

In the following, the invention will be described in more detail by means of a preferred embodiment shown in the accompanying drawing in which FIG. 1 shows schematically initial situation just before the thread to be spooled is moved onto an empty reel, FIG. 2 shows thread path right after catching and just before the thread is cut, FIG. 3 shows the situation after the thread has been cut and spooling continues onto the empty reel, FIG. 4 shows schematically one embodiment of the cutting means of the invention, and FIG. 5 shows an alternative detail of the embodiment of FIG. 4.

FIGS. 1–3 show schematically basic steps of continuous spooling. The thread to be spooled is marked with reference numeral 1. The term thread must in this connection be understood widely, ie. said thread can be a a bare thread, insulated thread, a wire, a fibre, a bunch of fibres, multi conductor cable, rope, etc. The reel that has become full in connection with spooling is marked with reference numeral 2, and the empty reel is marked with reference numeral 3. Reference numeral 4 shows the catching means for gripping the thread and guiding it onto the empty reel 2, and reference numeral 5 shows the cutting means for cutting the thread to be spooled.

The reels 2, 3 are rotated by means of the spooler in accordance with the arrows shown in FIGS. 1–3, the thread to be spooled thus spooling itself onto the reels in a manner known as such. For the sake of clarity, only those parts that are essential to the invention are shown in FIGS. 1–3. The general structure and operation of a spooler are fully known to one skilled in the art, wherefore they are not dealt with in more detail in this context. It is only noted in this context that after the reel 2 has become full, the thread to be spooled is moved by a suitable mechanism onto the path of the catching means 4 rotating with the empty reel 3. The catching means 4 is fitted for example onto a plate which is part of the structures on which the reel is mounted, the catching means thus rotating with the reel at the same speed as the reel. When the thread to be spooled moves onto the path of the catching means, the catching means 4 grips the thread and guides the thread onto the empty reel. The catching means 4 also pulls the thread to be spooled against the cutting means 5. In the prior art the catching means is typically formed by a stationary located V-formed blade structure, and the catching means, which is rotated with the reel, pulls the thread to be spooled into the V-formed slot having sharp edges and further towards the bottom of the V-formed slot whereby the thread is cut.

In the prior art problems have appeared in connection with cutting means. Said problems have appeared especially in connection with multiconductor cables and high production speeds as told above. The object of the invention is to eliminate the problems appeared in connection with the cutting means of the prior art.

According to the basic idea of the invention an active cutting mechanism is used instead of passive mechanisms used in the prior art, and tension of the thread to be cut is used to activate said active cutting mechanism.

FIG. 4 shows one embodiment of the cutting means of the invention. The mechanism shown in FIG. 4 can be located in a spooler in the way as shown in FIGS. 1–3, and therefore the cutter mechanism is marked generally with the reference number 5 in FIG. 4.

As shown in FIG. 4 the cutting means comprises two cutting blades 6, 7. In the embodiment of FIG. 4 the cutting blades have been pivoted together by a pivot point 8 so that one cutting blade 7 can move in the cutting direction. Said movement is shown by arrow K in FIG. 4. The assembly comprising blades 6, 7 and pivot point 8 can move as a unit as shown by arrow N in FIG. 4.

The cutting blade 7 leans against a counter surface 9 which urges said cutting blade to pivot around the pivot point 8. Said movement is achieved because the counter surface 9 and the direction shown by arrow N lie in an angle to each other. Reference number 10 shows a spring element.

When the catching means 4 grips the thread 1 to be spooled in the way and guides the thread onto the reel 3 as shown in FIG. 2, the thread 1 moves into the slot between the blades 6 and 7 as shown in FIG. 4. Reel 3 and also catching means 4 rotates further and the increasing pull of the thread 1 causes the cutting means 5 to move against the force of the spring element 10, and said movement forces the blade 7 to pivot around the pivot point 8 as shown by arrow K, and thus an effective pliers-like cutting action is obtained, and the thread 1 is cut as shown in FIG. 3. In this connection it is very important to realise that said cutting event is activated by the tension of the product, ie. the tension of the thread to be spooled. Said feature is very important because all synchronisation problems of the prior art can be eliminated with the invention. In the present invention synchronisation of the cutting event is carried out automatically, ie. the process activates cutting means, and therefore cutting takes place always in correct time, even in high production speeds.

In the embodiment of FIG. 4 cutting is carried out solely by the tension of the thread to be spooled. It is however quite possible within the basic thoughts of the invention to use a booster means to assist the movement of the blade in the direction of cutting, ie around the pivot point 8. Said booster means can be for example a pneumatic cylinder or a hydraulic cylinder which is activated by the movement of the cutting means 5 or blade 7. Said booster means is shown schematically by phantom lines and a reference number 11 in FIG. 4.

The blade 7 can be arranged to slide along the counter surface 9 as shown in FIG. 4, or alternatively it is possible to arrange a rolling element between the blade 7 and the counter surface 9 to lower friction effect as shown in FIG. 5.

The above-described embodiment is by no means intended to restrict the invention but the invention can be modified freely within the scope of the claims. It is thus necessary for the apparatus of the invention or its details to be exactly like shown in the Figures but that other types of solutions are also possible. FIG. 4 shows an embodiment in which one blade moves in the cutting direction. It is however quite possible to materialize the construction so that both blades move in the cutting direction. It is also quite possible to make the cutting means so that there are more than two cutting blades etc. The cutting means can be placed in the way as shown in FIGS. 1–3, but it must be noted that the invention is by no means restricted to said cutting means position. It is possible within the invention to place the cutting means for example to a place outside the spooler, and guide the thread to be spooled to the cutting means for cutting. It is also quite possible to materialize the apparatus so that the cutting means is a replaceable unit so that said cutting means can be selected according to the existing need.

The invention claimed is:

1. A spooling apparatus comprising:

means for rotatably mounting a first reel and a second reel;

catching means for guiding a thread to be spooled onto the first reel and further to the second reel; and cutting means for cutting the thread to be spooled when the thread to be spooled is guided from the first reel onto the second reel, whereby the cutting means comprises:

at least two cutting blades of which at least one moves at least in the cutting direction as a result of the tension of the thread to be cut, the cutting blades being pivoted together by a pivot point, and the at least one moving cutting blade moving in the cutting direction leaning against a counter surface which urges said at least one moving cutting blade to pivot around the pivot point as the cutting blades are moved by the tension of the thread to be cut in a direction which lies in an angle with the counter surface.

2. A spooling apparatus according to claim 1 wherein the tension of the thread to be cut moves the cutting blades against the force of a spring element.

3. A spooling apparatus according to claim 2 wherein the movement of the at least one moving cutting blade in the direction of cutting is assisted by a booster means.

4. A spooling apparatus according to claim 1 wherein the movement of the at least one moving cutting blade in the direction of cutting is assisted by a booster means.

5. A spooling apparatus according to claim 4 wherein the booster means is activated by initial movement of the cutting means or the cutting blade.

* * * * *